United States Patent [19]

Mahalek et al.

[11] Patent Number: 4,824,750

[45] Date of Patent: Apr. 25, 1989

[54] TONER COMPOSITIONS WITH A CROSSLINKED RESIN COMPONENT

[75] Inventors: Thomas L. Mahalek, Rochester; David R. Santo, Webster, both of N.Y.

[73] Assignee: Xerox Corporation, Stamford, Conn.

[21] Appl. No.: 114,998

[22] Filed: Oct. 30, 1987

[51] Int. Cl.[4] ..... G03G 13/16

[52] U.S. Cl. ..... 430/99; 430/106.6; 430/109; 430/124

[58] Field of Search ..... 430/99, 109, 110, 111, 430/106.6, 121, 122, 124, 126

[56] References Cited

U.S. PATENT DOCUMENTS

| | | | |
|---|---|---|---|
| 3,938,992 | 2/1976 | Jadwin et al. | 96/1 SD |
| 3,941,898 | 3/1976 | Sadamatsu et al. | 427/18 |
| 4,237,257 | 12/1980 | Moriya et al. | 526/230.5 |
| 4,339,337 | 7/1982 | Tricot et al. | 252/62.54 |
| 4,340,660 | 7/1982 | Kiuchi et al. | 430/109 |
| 4,481,274 | 11/1984 | Mitsuhashi et al. | 430/109 |
| 4,513,074 | 4/1985 | Nash et al. | 430/106.6 |
| 4,556,624 | 12/1985 | Gruber et al. | 430/110 |
| 4,617,249 | 10/1986 | Ober et al. | 430/137 |

*Primary Examiner*—John L. Goodrow
*Attorney, Agent, or Firm*—E. O. Palazzo

[57] ABSTRACT

A developer composition comprised of crosslinked styrene copolymers with an insoluble gel content of from about 20 to about 60 percent, pigment particles, low molecular weight wax components, first external additive particles of collodial silica, second external additive particles of fatty acid metal salts, and carrier particles.

25 Claims, No Drawings

TONER COMPOSITIONS WITH A CROSSLINKED RESIN COMPONENT

BACKGROUND OF THE INVENTION

This invention is generally directed to toner and developer compositions. More specifically, the present invention relates to toner compositions containing a highly crosslinked styrene resin. In one embodiment, thus there are provided in accordance with the present invention toner compositions comprised of highly crosslinked styrene methacrylate, or styrene acrylate resin particles, pigment particles, low molecular weight wax components, first additive particles, and second additive particles. Also, in another embodiment of the present invention developer compositions are formulated by admixing the aforementioned toners with carrier particles, preferably uncoated ferrites. The toner and developer compositions of the present invention are particularly useful in electrophotographic printing, and imaging methods, especially xerographic processes with soft roll fusers, and wherein release agents, such as silicone oils selected to prevent toner particles from adhering to the surface of fuser rolls, are avoided.

Toner compositions with crosslinked resins are known, for example, in U.S. Pat. No. Re. 31,072 (a reissue of 3,938,992), a toner composition with styrene crosslinked resin particles is disclosed, which resins are crosslinked to a sufficient extent to extend the useful fusing range by at least 10° C. as compared to uncrosslinked toner resins. Developer compositions and modifying materials for the toner are also disclosed in the '992 patent, see column 14, beginning at line 47, for example. A similar disclosure is presented in U.S. Pat. No. 3,941,898, the disclosure of which is totally incorporated herein by reference. In addition, there are illustrated in U.S. Pat. No. 4,513,074, the disclosure of which is totally incorporated herein by reference, stable conductive developer compositions comprised of first resin particles of styrene methacrylate copolymers grafted with, or containing a low molecular wax composition; second resin particles of a styrene, acrylate, acrylonitrile terpolymer; pigment particles; colloidal silica additive particles; fatty acid metal salt additives; and uncoated ferrite particles. The developer compositions of the present invention are similar to those illustrated in the aforementioned patent with the primary exception that there is selected in place of the first resin, and second resin particles a crosslinked styrene resin as illustrated hereinafter, which enables the formation of a more economical toner, and also provides other advantages.

Further, there are described in U.S. Pat. No. 4,604,338 positively charged dry toner compositions with colored pigments excluding black, which compositions contain first resin particles, second crosslinked resin particles, a low molecular weight wax, and certain charge enhancing additives. Additionally, toner and developer compositions, especially those containing charge enhancing additives, are well known, reference for example, U.S. Pat. Nos. 3,893,935; 3,944,493; 4,007,293; 4,079,014 and 4,394,430. Further, there is disclosed in U.S. Pat. No. 4,338,390 developer and toner compositions having incorporated therein as charge enhancing additives organic sulfate and sulfonate substances. A similar disclosure is present in U.S. Pat. No. 4,394,430. Moreover, there are disclosed in U.S. Pat. No. 4,298,672 positively charged toner compositions with resin particles and pigment particles; and as a charge enhancing additive, alkyl pyridinium compounds, inclusive of cetyl pyridinium chloride.

Additionally, toner and developer compositions useful in xerographic imaging processes, wherein silicone oils are not needed, are known, reference for example U.S. Pat. No. 4,556,624, the disclosure of which is totally incorporated herein by reference. In this patent, there are disclosed improved positively charged toner compositions comprised of a polyblend mixture of crosslinked copolymer compositions, a second polymer, pigment particles, and a particular wax component thereby enabling the toner compositions to be selected for imaging systems wherein release fluids are not required. The types of resin described in this patent and other patents relating to toner compositions, including those compositions useful in imaging methods without the need for release agents are polyamides, epoxies, diolefins, polyurethanes, vinyl resins, and polymeric esterification products of a dicarboxylic acid and a diol comprising a diphenol. Specific examples of known vinyl resins include homopolymers or copolymers of two or more vinyl monomers. Typical vinyl monomers are styrene, p-chlorostyrene, unsaturated mono-olefins such as ethylene, propylene, butylene, isobutylene and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate, and other similar acrylates; acrylonitrile, methacrylonitrile, acrylimide; vinyl ethers, such as vinyl methyl ether, vinyl isobutyl ether, vinyl ethyl ether, and the like; vinyl ketones such as vinyl methyl ketone, vinyl hexyl ketone, and methyl isopropenyl keton; and N-vinyl indole, N-vinyl pyrrolidene, and the like; styrene butadiene copolymers; and mixtures thereof.

As preferred toner resins illustrated in the '624 patent, there can be selected styrene polymers and the esterification products of a dicarboxylic acid, and a diol comprising a diphenol. The aforementioned polyesters are illustrated in U.S. Pat. No. 3,590,000. Other specific preferred toner resins include styrene/methacrylate copolymers, styrene/butadiene copolymers, polyester resins obtained from the reaction of bisphenol A and propylene oxide, followed by the reaction of the resulting product with fumaric acid, branched polyester resins resulting from the reaction of dimethylterephthalate, 1,3-butanedil, 1,2-propanediol, and pentaerythritol; and styrene butadiene copolymers prepared by a suspension polymerization process, reference U.S. Pat. No. 4,558,108.

Furthermore, illustrated in U.S. Pat. No. 3,418,354 are processes for obtaining olefin-polyoxyalkylene copolymers by a graft reaction with a peroxide whereby there are generated free radical sites on the backbone polymer. One process embodiment disclosed in the '354 patent involves the addition of an alpha olefin such as styrene, and a peroxide to a polyoxyalkylene compound, such as a siloxane, wherein there results a graft copolymer; and more specifically, an olefin-polyoxyalkylene graft copolymer, see column 2, line 23. In Japanese Patent Publication No. 46-9355, there is disclosed a procss for the preparation of graft block copolymers with a polysiloxane chain by the reaction of a functional polysiloxane with a polymer obtained from the anion polymerization of a styrene or a butadiene. Japanese Patent Publication No. 58-225103 discloses a method for the crosslinking of a thermoplastic resin by the reaction of a hydrogenated styrene-butadiene-styrene block copolymer with a silane in the presence of organic peroxides. Further, in U.S. Pat. No. 3,691,257 there are disclosed organic polymers modified by incorporating therein a polymer siloxane organic block copolymer; while Japanese Patent Publication No. 57-187345 describes a rubber modified styrene resin prepared by continuous bulk polymerizations in the presence of organic polysiloxanes and 1,2-vinyl polymers.

Other representative patents primarily of background interest include U.S. Pat. No. 4,237,257 relating to methods for preparing low molecular weight styrene series polymers useful as toners, which preparation involves the selection of an organic peroxide initiator; U.S. Pat. No. 4,339,337 relating to a suspension polymerization method for the preparation of magnetic beads from vinyl aromatic polymers, including styrenes, and where benzoyl initiators may be selected, reference column 3, line 17. Additionally, this patent indicates that a crosslinking monomer, reference divinylbenezene, may be added, reference column 2, line 39; and U.S. Pat. No. 4,617,249 relating to toners with a crosslinking compound, reference for example column 4, lines 42 to 64.

However, there is a need for new toner resins that possess desirable characteristics, and that are useful in electrophotographic imaging systems. Additionally, there is a need for economical toner compositions wherein a highly crosslinked single styrene resin is selected enabling toners for incorporation into xerographic imaging apparatus where fixing can be accomplished without the utilization of release fluids, and the apparatus associated therewith. There is also a need for toner compositions which are useful in the development of images, and wherein fixing is accomplished without the need for release fluids. In addition, there is a need for resins useful for the formulation of toner compositions that possess desirable mechanical properties, stable electrical properties, excellent fusing characteristics, and acceptable release properties. Moreover, there is a need for developer compositions containing therein the toner components illustrated herein, and carrier particles. There is also a need for imaging and printing methods wherein there are selected toner and developer compositions containing therein the compositions illustrated herein, and wherein release fluids, such as silicone oils, are avoided during the fusing process. Moreover, there is a need for developer compositions containing therein a toner with specific crosslinked styrene resins, which toners possess relatively low fusing temperatures, 350° F. for example, while maintaining high offset temperatures, 420° F. or greater for example. Additionally, there remains a need for improved toner compositions that are compatible with fusing rolls incorporated into imaging apparatuses, especially Viton fuser rolls.

SUMMARY OF THE INVENTION

It is an object of the present invention to provide toner compositions with the above noted advantages.

In another object of the present invention there are provided toner compositions containing a single highly crosslinked styrene resin admixed with other components.

In still a further object of the present invention there are provided toner compositions with stable triboelectric charging characteristics, that is for example these toners possess a tribo of from about a-5 to about a-30 microcoulombs per gram.

Another object of the present invention resides in the provision of toner and developer compositions that can be selected for imaging processes wherein the utilization of release fluids are avoided.

In a further object of the present invention there are provided specific toner compositions and processes, which are compatible with Viton fuser rolls.

These and other objects of the present invention are accomplished by providing toner and developer compositions which retain their electrical characteristics for extended time periods, and wherein the compositions can be utilized in electrophotographic imaging apparatus while avoiding the use of release fluids, such as silicone oils. More specifically, there are provided in accordance with the present invention toner compositions comprised of highly crosslinked styrene acrylates or styrene methacrylates, preferably with a gel content of from about 20 to about 60 percent; pigment particles; a low molecular weight wax component; first additive colloidal silica particles; and second additive particles comprised of the metal salts of fatty acids or fatty acids. In another embodiment of the present invention, there are provided developer compositions comprised of the forementioned toners, and carrier particles that are preferably free of any polymeric coatings thereover.

Illustrative examples of resins selected, which resins are crosslinked, for the toner compositions of the present invention include polyesters, diolefin polymers such as styrene butadiene resins, styrene/methacrylates, polyamides, epoxies, polyurethanes, vinyl resins, and the like, reference U.S. Pat. No. 4,604,338, the disclosure of which is totally incorporated herein by reference. Particularly preferred resins selected for the toner and developer compositions of the present invention are comprised of crosslinked co and terpolymers of styrene acrylates and styrene methacrylates, and wherein the crosslinking component selected is usually divinylbenzene.

The aforementioned resins are crosslinked with various components including aromatic, and nonaromatic substances such as divinyl benzene, ethylene glycol, dimethyl acrylate, glycol dimethacrylates, and the like. It is important that the resin particles be crosslinked to enable the undesirable offsetting of the toner image to the fuser rolls, extended fuser wearability, and improved release associated with the transfer of the developer image from the imaging member to a suitable substrate, such as paper. Crosslinked resins that may be selected for the toner compositions of the present invention are illustrated in U.S. Pat. No. 4,556,624, the disclosure of which is totally incorporated herein by reference. Specifically, thus there are selected for the toner compositions of the present invention crosslinked copolymers or terpolymers of styrene acrylates and styrene methacrylates, or mixtures thereof, which resins generally have an insoluble gel content of from about 20 to about 60 percent as determined by solvent extraction techniques with, for example, toluene or tetrahydrofuran solvents. Moreover, during formulation of the crosslinked resins there is usually added prior to polymerization a free radical polyerization initiator such as benzyl peroxide, which initiator is present in an effective amount depending on the amounts of the other components. For example, the ratio of initiator to crosslinking component is approximately, in a preferred embodiment, 10:1; and more specifically, in a very preferred embodiment, about 1.0 percent by weight of initiator based on the weight of the monomer, and 0.1 percent by weight of the crosslinking component are selected. Other preferred amounts include 3.0 percent by weight of initiator and 0.3 percent by weight of crosslinking agent and 4.6 percent by weight of initiator and 0.4 percent by weight of crosslinking compound. In one illustrative embodiment, the crosslinked resins of the present invention are prepared by reacting in water insitu monomers with the crosslinking component and initiator, such as benzoyl peroxide, at a temperature of from about 40° to about 90° C.; followed by cooling to room temperature, and separation of the resulting beads from the water phase, which beads are then dried. Generally, from about 45 to about 55 percent by weight of monomer, such as styrene, and 55 to 45 percent by weight of the second monomer, such as methacrylate, are suspended with a suitable suspending agent, such as tricalcium phosphate, 0.5 percent by weight, in water at a ratio of about 1.4 parts water to 1 part of monomer mixture.

The aforementioned illustrated resins can be formulated into toner compositions, including colored toner compositions, by adding thereto pigment partices such as carbon black, cyan, magenta, yellow, red, green, blue, or mixtures thereof, and the like, in an amount of from about 1 to about 20 percent by weight. Numerous well known suitable pigments or dyes can be selected as the colorant for the toner particles including, for example, carbon black, nigrosine dye, aniline blue, magnetites, and mixtures thereof. The pigment, which is preferably carbon black, should be present in a sufficient amount to render the toner composition highly colored thus enabling the formation of a clearly visible image on a suitable recording member. Generally, the pigment particles are present in amounts of from about 1 percent by weight to about 20 percent by weight, and preferably from about 8 to about 20 percent by weight, based on the total weight of the toner composition; however, lesser or greater amounts of pigment particles can be selected providing the objectives of the present invention are achieved.

In addition, as indicated herein the pigment particles can also be selected from cyan, magenta, yellow, blue, red, green, and other similar colored pigments, or mixtures thereof, enabling the formation of colored toner compositions. These pigments are generally present in the toner compositions in an amount of from about 2 percent by weight to about 30 percent by weight. Illustrative examples of cyan, magenta and yellow pigments that can be selected include, for example, 2,9-dimethyl-substituted quinacridone and anthraquinone dyes identified in the Color Index as Cl 60710, Cl dispersed Red 15, a diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like, while illustrative examples of yellow pigments that may be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color index as Foron Yellow SE/GLN, Cl Dispersed yYellow 33,2,5-dimethoxy-4-sulfonanilide phenylazo-4'-chloro-2,5-dimethoxy aceto-acetanilide, Permanent Yellow FGL, and other similar compositions.

Examples of waxes, which are available from Allied Chemical, Petrolite, Inc., and Sanyo, Inc., are generally present in an amount of from about 0.5 to about 15 percent by weight. Generally, these waxes possess a weight average molecular weight of from about 500 to about 20,000, and preferably from about 1,000 to about 5,000, such as polyethylenes and polypropylenes, reference U.S. Pat. No. 4,604,338, and British No. 1,442,835, the disclosures of which are totally incorporated herein by reference.

The toner and developer compositions of the present invention also contain therein first and second external additive components, the first additive component being comprised of silica particles, and the second additive components being comprised of fatty acids, or fatty acid metal salts thereof. Examples of silicas include Aerosil R972, reference U.S. Pat. No. 3,983,045, the disclosure of which is totally incorporated herein by reference, and the like; while examples of the second additives are zinc stearate, calcium stearate, and the like, reference for example U.S. Pat. Nos. 3,590,000 and 3,320,169, the disclosures of which are totally incorporated herein by reference. These additives are usually present in an amount of from about 0.5 to about 1 percent by weight, and preferably 0.7 percent by weight. These additives are added subsequent to the preparation of the toner compositions.

Illustrative examples of carrier particles that can be selected for mixing with the toner of the present invention, thus enabling developer compositions, include those particles that are capable of triboelectrically obtaining a charge of opposite polarity to that of the toner particles. Accordingly, the carrier particles of the present invention can be selected so as to be of a negative or positive polarity, allowing the toner particles which are positively or negatively charged to adhere to and surround the carrier particles. Illustrative examples of carrier particles include methyl methacrylate, glass, steel, nickel, iron, ferrites, and the like. Additionally, there can be selected as carrier particles nickel berry carriers as illustrated in U.S. Pat. No. 3,847,604, the disclosure of which is totally incorporated herein by reference, which carriers are comprised of nodular carrier beads of nickel characterized by surfaces of reoccurring recesses and protrusions thereby providing particles with a relatively large external area. The selected carrier particles can be used with or without a coating, the coating generally being comprised of fluoropolymers, such as polyvinylidenefluoride resins, terpolymers of styrene, methylmethacrylate, and a silane, such as vinyl triethoxysilane, tetrafluoroethylenes, copolymers available as FP 461, other known coatings, and the like. Preferred are the uncoated ferrites illustrated in U.S. Pat. No. 3,914,181, the disclosure of which is totally incorporated herein by reference.

While the diameter of the carrier particles can vary, generally it is from about 50 microns to about 1,000 microns, thus allowing these particles to possess sufficient density and inertia to avoid adherence to the electrostatic images during the development process. The carrier particles can be mixed with the toner composition in various suitable combinations, however, best results are obtained when about 1 part to about 10 parts toner to about 200 parts by weight of carrier are selected.

The toner compositions of the present invention can be prepared by a number of known methods including melt blending the toner resin particles containing the pigment particles and wax, followed by mechanical attrition. Thereafter, the first and second additive particles are added thereto. Other methods include those well known in the art such as spray drying, melt dispersion, dispersion polymerizations, suspension polymerizations, and extrusion processes.

Also, the toner and developer compositions of the present invention may be selected for use in developing images in electrophotographic imaging systems containing therein conventional photoreceptors, such as selenium, and selenium alloys. Illustrative examples of layered photoresponsive devices, which can be selected for use with the toner and developer compositions of the present invention include those comprised of transport layers and photogenerating layers, reference U.S. Pat. No. 4,265,990, the disclosure of which is totally incorporated herein by reference. Examples of generating layers include trigonal selenium, metal phthalocyanines, metal free phthalocyanines, squaraine pigments and vanadyl phthalocyanines; while examples of charge transport layers include the aryl amines as disclosed in U.S. Pat. No. 4,265,990. With negatively charged layered imaging members, there are incorporated into the toner compositions charge enhancing additives such as alkyl pyridinium halides, distearyl dimethyl ammonium methyl sulfate, and the like. These additives, which are present in an amount of from about 0.1 percent to about 15 percent by weight, are selected since the layered imaging members are usually negatively charged, thus positively charged toner compositions are needed.

The following examples are being supplied to further define various species of the present invention, it being noted that these examples are intended to illustrate and not to limit the scope of the present invention. Parts and percentages are by weight unless otherwise indicated.

EXAMPLE 1

A crosslinked styrene methacrylate copolymer composition was prepared by bead suspension as described herein, which composition was comprised of 51 parts of a styrene monomer, 49 parts of n-butyl methacrylate monomer, 4.6 parts of benzoyl peroxide, and 0.4 parts of divinylbenzene. This resin had an insoluble gel content of 30 percent as determined by solvent extraction with toluene.

Thereafter, a toner composition was formulated by admixing the above prepared styrene n-butyl methacrylate crosslinked resin particles, 84 percent by weight, with 6 parts by weight of polypropylene wax, available from Sanyo, Inc., which wax is believed to have a weight average molecular weight of about 5,000; and 10 parts by weight of carbon black, which preparation involved melt mixing in a Banbury apparatus.

There was added, subsequent to removal of the above toner from the Banbury, after roll milling, jetting, and classification to remove toner particles with an average diameter of 5 microns or less thereby resulting in toner particles with a volume average of 11.5 to 13.5 microns, to the prepared toner composition 0.7 percent by weight of Aerosil R972, and 0.7 percent by weight of zinc stearate as external additives. This toner composition had a low fusing temperature of 350° F.

Thereafter, there was prepared a developer composition by admixing two parts by weight of the above prepared toner composition with 98 parts by weight of ferrite carrier particles. The toner composition had a triboelectric charge thereon of −15 microcoulombs per gram as determined in a Faraday Cage apparatus.

The above prepared developer was then incorporated into a xerographic imaging test fixture containing a positively charged selenium photoconductor, and there resulted for 50,000 imaging cycles images of excellent resolution with no background deposits. Moreover, no toner offsetting at 420° F. to the fuser roll in the imaging test fixture was observed; it being noted that this fixture did not contain any silicone oil release fluid.

EXAMPLE II

A toner and developer composition was prepared by repeating the procedure of Example I with the exception that there was selected a crosslinked styrene n-butyl methacrylate resin with an insoluble gel content of 40 percent, and substantially similar results were achieved.

Other modifications of the present invention may occur to those skilled in the art subsequent to a review of the present application, and these modifications are intended to be included within the scope of the present invention.

What is claimed is:

1. A developer composition consisting essentially of crosslinked styrene copolymers with an insoluble gel content of from about 20 to about 60 percent, pigment particles, low molecular weight wax components, first external additive particles of colloidal silica, second external additive particles of fatty acid metal salts, and carrier particles.

2. A composition in accordance with claim 1 wherein uncoated ferrite carrier particles are selected.

3. A composition in accordance with claim 1 wherein the styrene resin particles possess a gel content of from about 25 to about 40 percent.

4. A composition in accordance with claim 1 wherein the crosslinked styrene copolymers are crosslinked with divinylbenzene.

5. A composition in accordance with claim 1 wherein the crosslinked styrene copolymers are crosslinked with from about 0.25 percent to about 0.5 percent by weight of a crosslinking component.

6. A composition in accordance with claim 1 wherein the crosslinked styrene copolymers are selected from the group consisting of styrene acrylates, and styrene methacrylates.

7. A composition in accordance with claim 1 wherein the pigment particles are comprised of carbon black.

8. A composition in accordance with claim 1 wherein the pigment particles are selected from the group consisting of magnetites, and mixtures of carbon black and magnetites.

9. A composition in accordance with claim 1 wherein the pigment particles are selected from the group consisting of cyan, magenta, yellow, red, blue, green, and mixtures thereof.

10. A composition in accordance with claim 7 wherein the pigment particles are present in an amount of from about 1 percent by weight to about 20 percent by weight.

11. A composition in accordance with claim 9 wherein pigment particles are present in an amount of from about 2 percent by weight to about 30 percent by weight.

12. A composition in accordance with claim 1 wherein the second additive particles are zinc stearate.

13. A composition in accordance with claim 1 wherein the additive particles are present in an amount of from about 0.1 to about 1 percent by weight.

14. A composition in accordance with claim 1 wherein the wax component has a weight average molecular weight of from about 1,000 to about 6,000.

15. A composition in accordance in accordance with claim 14 wherein the wax is selected from the group consisting of polyethylene and polypropylene.

16. A method of imaging which comprises the formation of an electrostatic latent image on an imaging member in an imaging apparatus, followed by development of this image with the developer composition of claim 1, subsequently transferring this imag to a suitable substrate, and thereafter permanently affixing the image thereto.

17. A method of imaging in accordance with claim 16 wherein fusing is accomplished in the absence of a release fluid by means of a fuser roll present in the imaging apparatus, and substantially no offsetting occurs on the fuser roll.

18. A toner composition consisting essentially of crosslinked styrene copolymers with an insoluble gel content of from about 20 to about 60 percent, pigment particles, low molecular weight wax components, first external additive particles of colloidal silica, and second external additive particles of fatty acid metal salts.

19. A method of imaging which comprises the formation of an electrostatic latent image on an imaging member in an imaging apparatus, followed by development of this image with the developer composition of claim 18, subsequently transferring this image to a suitable substrate, and thereafter permanently affixing the image thereto.

20. A method of imaging in accordance with claim 19 wherein fusing is accomplished in the absence of a release fluid by means of a fuser roll present in the imaging apparatus, and substantially no offsetting occurs on the fuser roll.

21. A toner composition in accordance with claim 18 wherein the resin particles are crosslinked with divinylbenzene.

22. A toner composition in accordance with claim 18 wherein the styrene copolymers are selected from the group consisting of styrene acrylates and styrene methacrylates.

23. A toner composition in accordance with claim 18 wherein the second additive particles are zinc stearate.

24. A toner composition in accordance with claim 18 wherein the pigment particles are selected from the group consisting of carbon black, magnetites, or mixtures thereof.

25. A toner composition in accordance with claim 18 wherein the wax is of a weight average moleculare weight of from about 1,000 to about 6,000.

* * * * *